US007967529B2

(12) United States Patent
Kuo et al.

(10) Patent No.: US 7,967,529 B2
(45) Date of Patent: Jun. 28, 2011

(54) OCEAN WATER DRAWING SYSTEM

(75) Inventors: Yeh-Huei Kuo, Taipei (TW); Bing-Sheng Yu, Taipei (TW)

(73) Assignee: Kuan-Hsiung Hsu, Luzhu Shiang, Taoyuan Country (TW)

( * ) Notice: Subject to any disclaimer, the term of this patent is extended or adjusted under 35 U.S.C. 154(b) by 375 days.

(21) Appl. No.: 12/209,339

(22) Filed: Sep. 12, 2008

(65) Prior Publication Data

US 2009/0074513 A1 Mar. 19, 2009

(30) Foreign Application Priority Data

Sep. 14, 2007 (TW) ..... 96134460 A

(51) Int. Cl.
*E02B 3/00* (2006.01)

(52) U.S. Cl. ..... 405/80; 405/107; 405/114

(58) Field of Classification Search ..... 405/75, 405/78, 80, 107, 110, 114, 116, 117
See application file for complete search history.

(56) References Cited

U.S. PATENT DOCUMENTS

| | | | | |
|---|---|---|---|---|
| 4,129,010 A | | 12/1978 | Owen | |
| 4,143,990 A | * | 3/1979 | Atencio | 405/78 |
| 6,575,662 B2 | * | 6/2003 | French | 405/80 |

FOREIGN PATENT DOCUMENTS

| | | |
|---|---|---|
| JP | 2005-290959 A | 10/2005 |
| TW | 200636151 | 10/2006 |

* cited by examiner

*Primary Examiner* — David J Bagnell
*Assistant Examiner* — Benjamin Fiorello
(74) *Attorney, Agent, or Firm* — Ladas & Parry LLP

(57) ABSTRACT

An ocean water drawing system includes: a well; a working tunnel disposed underground and having an end segment distal from the well; a pipeline unit including a primary pipeline disposed in the working tunnel, and having one end extending sealingly into the well and the other end extending through the end segment of the working tunnel and into an ocean so as to permit ocean water to flow into the well through the primary pipeline; and an access tunnel isolated from the well and extending downwardly from a ground surface to intersect the working tunnel so as to communicate spatially with the working tunnel and so as to permit access into the end segment of the working tunnel for operation and maintenance of the primary pipeline.

15 Claims, 5 Drawing Sheets

OCEAN WATER DRAWING SYSTEM

CROSS-REFERENCE TO RELATED APPLICATION

This application claims priority of Taiwanese Application No. 096134460, filed on Sep. 14, 2007.

BACKGROUND OF THE INVENTION

1. Field of the Invention

The invention relates to an ocean water drawing system, more particularly to an ocean water drawing system including a working well, a working tunnel, a pipeline disposed in the working tunnel and in fluid communication with the working well and the ocean, and an access tunnel extending downwardly from the ground surface to intersect the working tunnel for access into the working tunnel.

2. Description of the Related Art

Referring to FIG. 1, a conventional ocean water drawing system includes a well 12 disposed adjacent to a seashore of an ocean 14 and extending downwardly from a ground surface 11, and a pipe 13 made from high density polyethylene (HDPE) and extending from a bottom of the well 12 into the ocean 14 so as to draw ocean water from the ocean 14 into the well 12. The pipe 13 has a horizontal section extending from the well 12 through a soil or a bedrock layer in the vicinity of the seashore and into the ocean 14 at a first level proximate to that of the bottom of the well 12, and an end section disposed in the ocean 14 and extending downwardly from the horizontal section to a desired depth for drawing the ocean water at a second level much deeper than the first level. However, the conventional ocean water system is disadvantageous in that it requires expensive pumping equipment and that maintenance of the pipe 13 requires diving experts and is relatively difficult and inconvenient. Moreover, the end section of the pipe 13 tends to be damaged due to long exposure to the sea water. Furthermore, the drawn ocean water can be contaminated when the end section of the pipe 13 is broken and causes undesired level(s) of the ocean water to enter into the end section of the pipe 13.

To overcome some of the aforesaid drawbacks, referring to FIG. 2, another conventional ocean water drawing system has been proposed. The proposed ocean water drawing system includes a well 16 and a tunnel 15 having an inclined section extending downwardly from a bottom of the well 16, and a horizontal section extending from the inclined section through a soil layer or a bedrock layer in the vicinity of the seashore and into the ocean 14 at a level proximate to that of the horizontal section. The ocean water can flow into the well 16 through hydrostatic pressure without using expensive pumping equipment. However, the conventional ocean water drawing system still has the aforesaid disadvantage of maintaining an outlet 151 of the tunnel 15.

SUMMARY OF THE INVENTION

Therefore, the objective of the present invention is to provide an ocean water drawing system that can eliminate or alleviate at least one of the aforementioned drawbacks associated with the prior art.

Accordingly, there is provided an ocean water drawing system that comprises: a well adapted to be disposed adjacent to a seashore; a working tunnel disposed underground and extending between the well and the seashore, the working tunnel being isolated from the well and the ocean, and having an end segment distal from the well and proximate to the seashore; a pipeline unit including a primary pipeline disposed in the working tunnel, and having one end extending sealingly into the well and the other end extending through the end segment of the working tunnel and into the ocean so as to permit ocean water to flow into the well through the primary pipeline; and an access tunnel isolated from the well and extending downwardly from a ground surface to intersect the working tunnel so as to communicate spatially with the working tunnel and so as to permit access into the end segment of the working tunnel for operation and maintenance of the primary pipeline.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
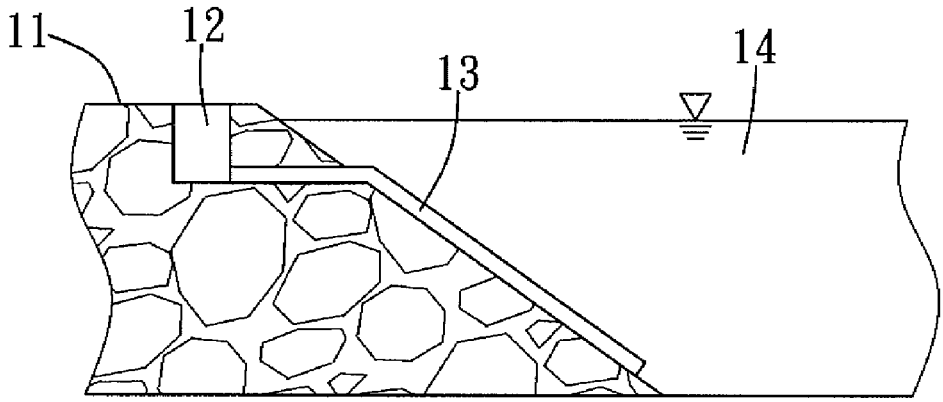
FIG. 1 PRIOR ART
FIG. 1 is a fragmentary schematic side view of a conventional ocean water drawing system.
Figure 2:
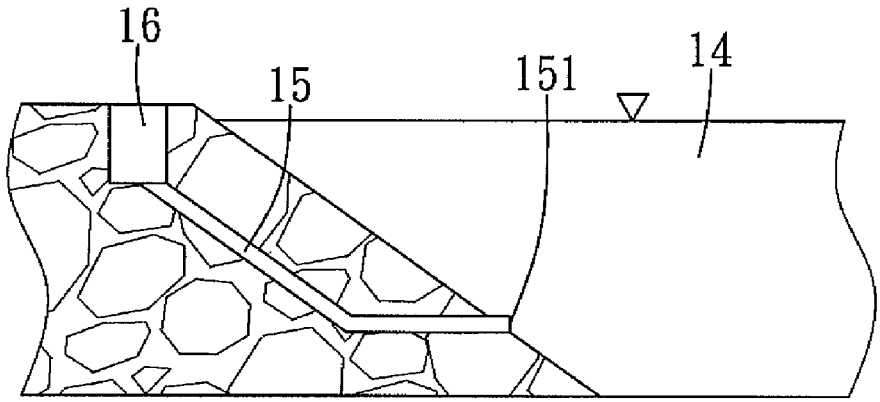
FIG. 2 PRIOR ART
FIG. 2 is a fragmentary schematic side view of another conventional ocean water drawing system.

Before the present invention is described in greater detail with reference to the accompanying preferred embodiment, it should be noted herein that like elements are denoted by the same reference numerals throughout the disclosure.

Figure 3:
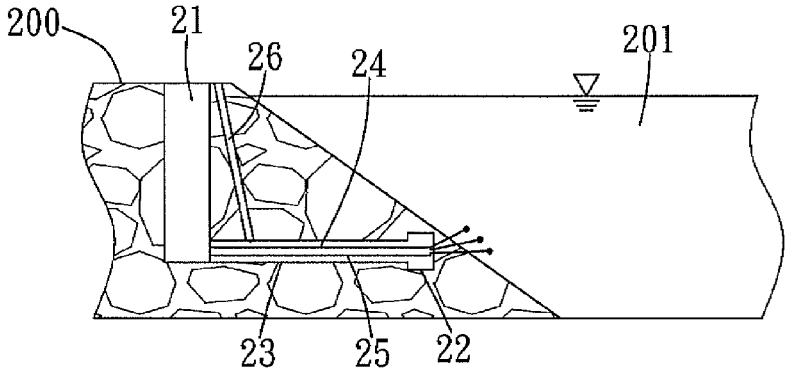
FIG. 3 is a fragmentary schematic side view of the first preferred embodiment of an ocean water drawing system according to the present invention.
Figure 4:
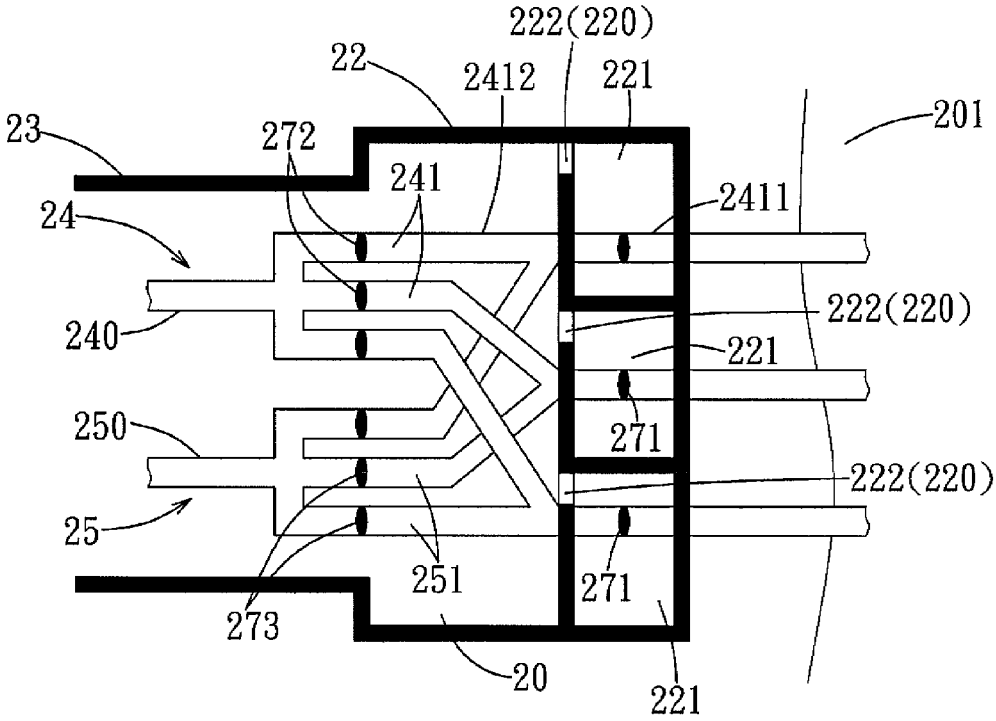
FIG. 4 is a fragmentary schematic top view, illustrating the configurations of a working chamber and primary and secondary pipelines of the first preferred embodiment.

Referring to FIGS. 3 and 4, the first preferred embodiment of an ocean water drawing system according to the present invention is shown to include: a first well 21 adapted to be disposed adjacent to a seashore of an ocean 201; a first working tunnel 23 disposed underground and extending between the first well 21 and the seashore, the first working tunnel 23 being isolated from the first well 21 and the ocean 201, and having an end segment 22 distal from the first well 21 and proximate to the seashore; a first pipeline unit including a primary pipeline 24 disposed in the first working tunnel 23 and having one end extending sealingly into the first well 21 and the other end extending through the end segment 22 of the first working tunnel 23 and into the ocean 201 so as to permit ocean water to flow into the first well 21 through the primary pipeline 24; and an access tunnel 26 isolated from the first well 21 and extending downwardly from a ground surface 200 to intersect the first working tunnel 23 so as to communicate spatially with the first working tunnel 23 and so as to permit access into the end segment 22 of the first working tunnel 23 for operation and maintenance of the primary pipeline 24. In this embodiment, the first well 21 is excavated to a depth that has the same sea level where the desired ocean water is to be drawn. The primary pipeline 24 extends from a bottom of the first well 21. The depth of the first well 21 can be higher than the sea level from which the ocean water is to be drawn according to actual requirements. In such condition, the first working tunnel 23 is extended inclinedly and downwardly to a level corresponding to the sea level from which the ocean water is to be drawn.

The end segment 22 of the first working tunnel 23 defines a working chamber 20 therein. The working chamber 20 is partitioned so as to form a plurality of compartments 221 which are isolated from each other. Each of the compartments 221 is defined by a compartment-defining wall that has a compartment entrance 220 and that is provided with a compartment gate 222 for opening and closing the compartment entrance 220. The primary pipeline 24 includes a main pipe 240 and a plurality of branch pipes 241, each of which extends from an end of the main pipe 240 through a respective one of the compartments 221 and into the ocean 201, and each of which has a first section 2411 disposed in the respective one of the compartments 221 and provided with a first control valve 271 for blocking and unblocking ocean water flowing therethrough. The branch pipes 241 cooperatively define the other end of the primary pipeline 24.

Each of the branch pipes 241 further has a second section 2412 extending from the first section 2411, disposed outwardly of the respective one of the compartments 221, and provided with a second control valve 272 for blocking and unblocking ocean water flowing therethrough.

The first pipeline unit further includes a secondary pipeline 25 disposed in the first working tunnel 23 and having one end extending into the first well 21, and the other end extending through the end segment 22 of the first working tunnel 23 and into the ocean 201 so as to permit ocean water to flow into the first well 21 through the secondary pipeline 25.

The secondary pipeline 25 includes a main pipe 250 and a plurality of branch pipes 251, each of which extends from an end of the main pipe 250 of the secondary pipeline 25 to join the second section 2412 of a respective one of the branch pipes 241 of the primary pipeline 24, and each of which is provided with a third control valve 273 for blocking and unblocking ocean water flowing therethrough.

In this embodiment, the primary and secondary pipelines 24, 25 are made from high density polyethylene (HDPE).

Figure 5:
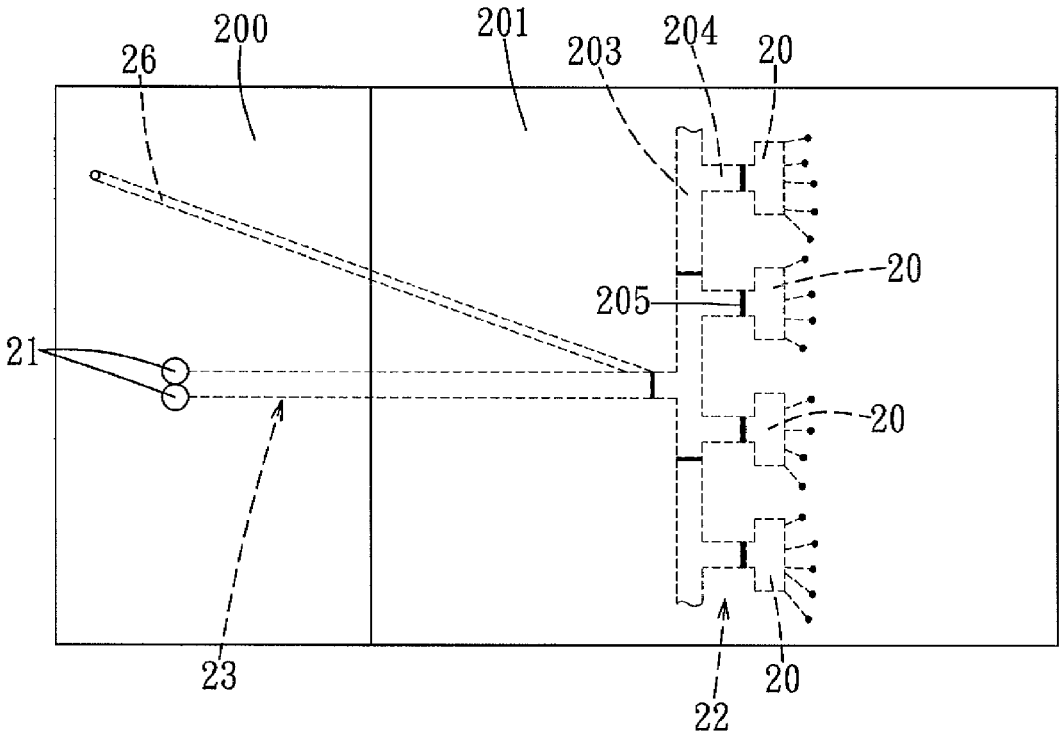
FIG. 5 is a fragmentary schematic top view of the second preferred embodiment of an ocean water drawing system according to the present invention.
Figure 6:
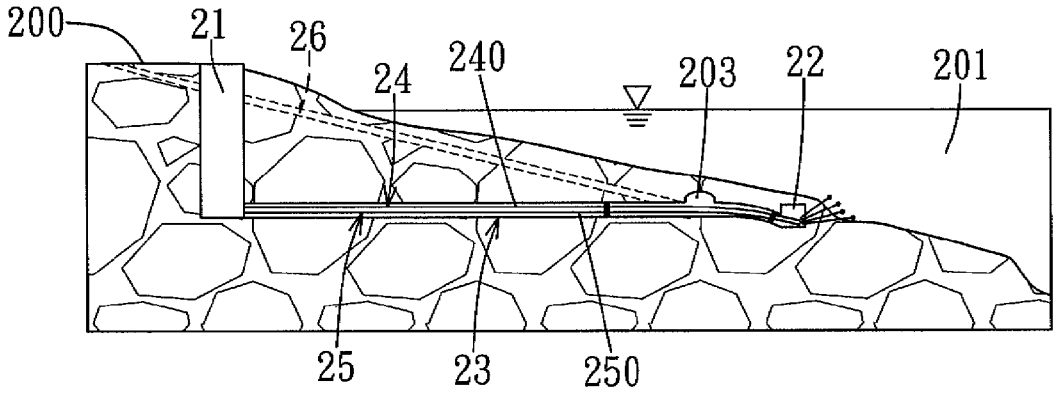
FIG. 6 is a schematic side view of the second preferred embodiment.
Figure 7:
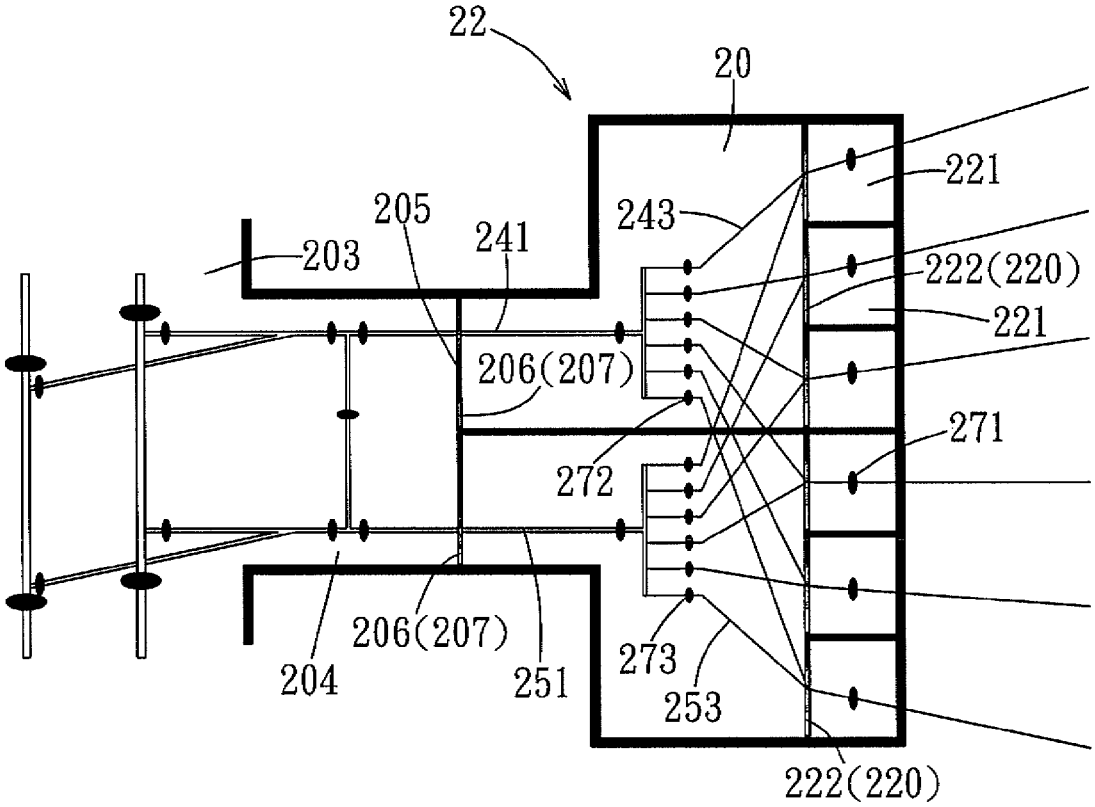
FIG. 7 is a fragmentary schematic top view, illustrating the configurations of a working chamber and primary and secondary pipelines of the second preferred embodiment.

Referring to FIGS. 5 to 7, the second preferred embodiment of the present invention differs from the first preferred embodiment in that the second preferred embodiment further includes a second well 21 disposed adjacent to the first well 21 and that the end segment 22 of the first working tunnel 23 defines a plurality of working chambers 20 and a main connecting chamber 203 in spatial communication with the working chambers 20 through a plurality of branch connecting chambers 204, respectively. Each of the working chambers 20 is defined by a chamber-defining wall, and is partitioned to form a plurality of compartments 221 that are isolated from each other. A partitioning wall 205 is provided in each of the branch connecting chambers 204 to isolate the main connecting chamber 203 from a respective one of the working chambers 20, is formed with entrances 206, and is provided with gates 207 for closing and opening the entrances 206, respectively.

In this embodiment, the primary and secondary pipelines 24, 25 of the first pipeline unit have branches (not shown) extending into the first and second wells 21. Each of the primary and secondary pipelines 24, 25 includes a main pipe 240, 250 and a plurality of branch pipes 241, 251, each of which is connected to the main pipe 240, 250, each of which extends through a respective one of the branch connecting chambers 204 and into a respective one of the working chambers 20, and each of which has a plurality of sub-branch pipes 243, 253. Each of the sub-branch pipes 243, 253 of each of the branch pipes 241, 251 extends through a respective one of the compartments 221 of a respective one of the working chambers 20 and into the ocean 201, and has a first section disposed in the respective one of the compartments 221 and provided with a first control valve 271 for blocking and unblocking ocean water flowing therethrough, and a second section extending from the first section, disposed outwardly of the respective one of the compartments 221, and provided with a second control valve 272, 273 for blocking and unblocking ocean water flowing therethrough. In addition, each of the branch pipes 241, 251 has a section disposed in the respective one of the branch connecting chambers 204 and provided with control valves.

Figure 8:
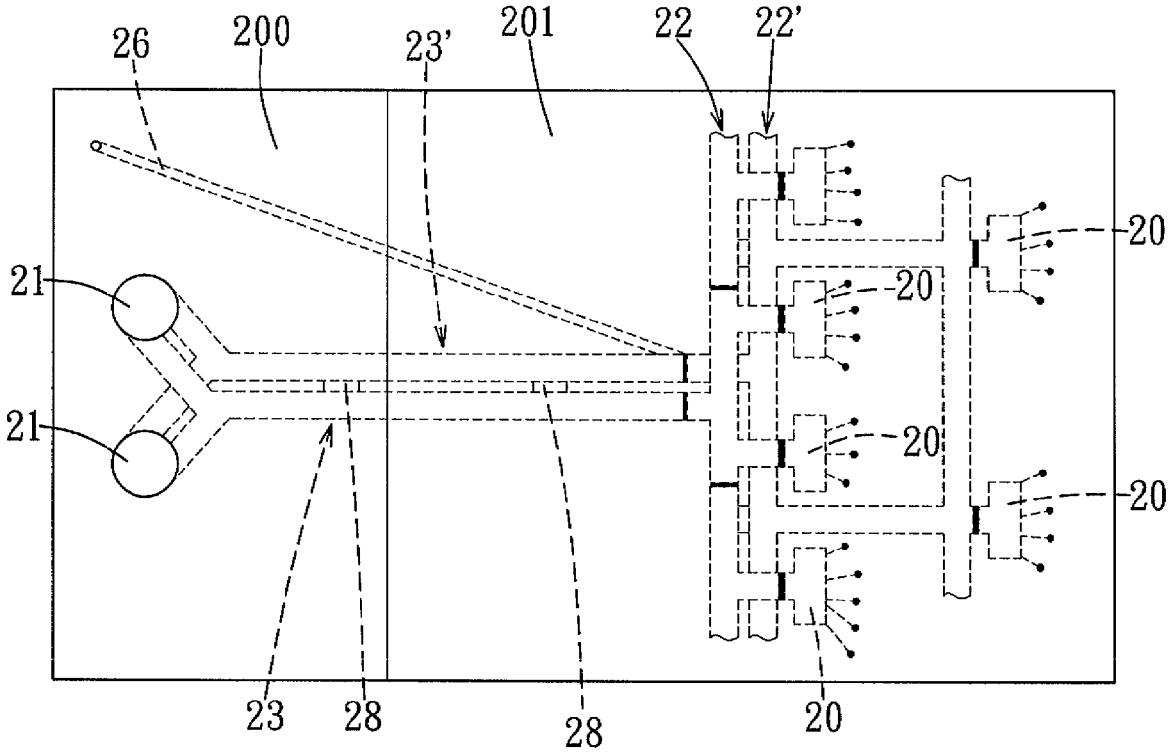
FIG. 8 is a fragmentary schematic top view of the third preferred embodiment of an ocean water drawing system according to the present invention.
Figure 9:
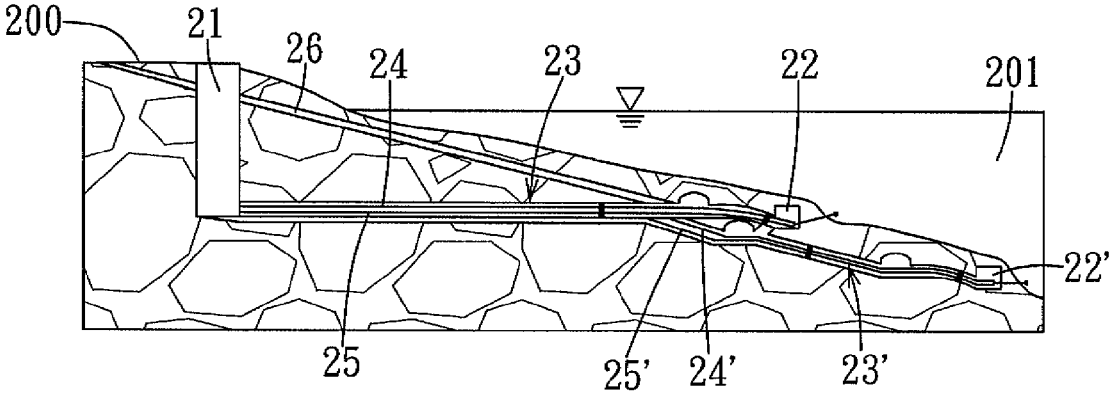
FIG. 9 is a schematic side view of the third preferred embodiment.

Referring to FIGS. 8 and 9, the third preferred embodiment of the present invention differs from the second preferred embodiment in that the third preferred embodiment further includes a second working tunnel 23' extending between the second well 21 and the seashore. The second working tunnel 23' is isolated from the second well 21 and the ocean 201, and has an end segment 22' disposed proximate to the seashore. The third preferred embodiment further includes a second pipeline unit disposed in the second working tunnel 23'. The second pipeline unit includes primary and secondary pipelines 24', 25' that have structures similar to those of the primary and secondary pipelines 24, 25 of the first pipeline unit of the previous embodiments. The first and second tunnels 23, 23' have branches extending to the second and first wells 21, respectively. The primary and secondary pipelines 24, 25 of the first pipeline unit and the primary and secondary pipelines 24', 25' of the second pipeline unit have branches (not shown) extending into the first and second wells 21, respectively.

In this embodiment, the end segment 22' of the second working tunnel 23' is extended into the ocean 201 at a depth deeper than that of the end segment 22 of the first working tunnel 23 so as to permit drawing of different levels of the ocean water from the ocean 201 to the first and second wells 21.

In this embodiment, the first and second working tunnels 23, 23' are interconnected through interconnecting tunnels 28 so as to permit access from one of the first and second tunnels 23, 23' to the other of the first and second tunnels 23, 23'.

With the inclusion of the access tunnel 26 and the working chamber(s) 20 in the ocean water drawing system of this invention, the aforesaid drawback(s) associated with the prior art can be alleviated or eliminated, and with the inclusion of the first and second wells 21, the first and second tunnels 23, 23' and the first and second pipeline units in the ocean water drawing system of this invention, various operating modes of how to draw the ocean water for satisfying actual requirements can be achieved.

While the present invention has been described in connection with what are considered the most practical and preferred embodiments, it is understood that this invention is not limited to the disclosed embodiments but is intended to cover various arrangements included within the spirit and scope of the broadest interpretation so as to encompass all such modifications and equivalent arrangements.

What is claimed is:

1. An ocean water drawing system comprising:

a first well adapted to be disposed adjacent to a seashore;

a first working tunnel disposed underground and extending between said first well and the seashore, said first working tunnel being isolated from said first well and the ocean, and haying an end segment distal from said first well and proximate to the seashore;

a first pipeline unit including a primary pipeline disposed in said first working tunnel, and having one end extending sealingly into said first well and the other end extending through said end segment of said first working tunnel and into the ocean so as to permit ocean water to flow into said first well through said primary pipeline; and an access tunnel isolated from said first well and extending downwardly from a ground surface to intersect said first working tunnel so as to communicate spatially with said first working tunnel and so as to permit access into said end segment of said first working tunnel for operation and maintenance of said primary pipeline;

wherein said end segment of said first working tunnel defines a working chamber therein, said working chamber being partitioned so as to form a plurality of compartments which are isolated from each other, each of said compartments being defined by a compartment-defining wall that has a compartment entrance and that is provided with a compartment gate for opening and closing said compartment entrance, said primary pipeline including a main pipe and a plurality of branch pipes, each of which extends from an end of said main pipe through a respective one of said compartments and into the ocean, and each of which has a first section disposed in the respective one of said compartments and provided with a first control valve for blocking and unblocking ocean water flowing therethrough.

2. The ocean water drawing system as claimed in claim 1, wherein each of said branch pipes further has a second section extending from said first section, disposed outwardly of the respective one of said compartments, and provided with a second control valve for blocking and unblocking ocean water flowing therethrough.

3. The ocean water drawing system as claimed in claim 2, wherein said first pipeline unit further includes a secondary pipeline disposed in said first working tunnel and having one end extending into said first well and the other end extending through said end segment of said first working tunnel and into the ocean so as to permit ocean water to flow into said first well through said secondary pipeline.

4. The ocean water drawing system as claimed in claim 3, wherein said secondary pipeline includes a main pipe and a plurality of branch pipes, each of which extends from an end of said main pipe of said secondary pipeline to join said second section of a respective one of said branch pipes of said primary pipeline, and each of which is provided with a third control valve for blocking and unblocking ocean water flowing therethrough.

5. An ocean water drawing system comprising:

a first well adapted to be disposed adjacent to a seashore;

a first working tunnel disposed underground and extending between said first well and the seashore, said first working tunnel being isolated from said first well and the ocean, and having an end segment distal from said first well and proximate to the seashore;

a first pipeline unit including a primary pipeline disposed in said first working tunnel, and having one end extending sealingly into said first well and the other end extending through said end segment of said first working tunnel and into the ocean so as to permit ocean water to flow into said first well through said primary pipeline; and an access tunnel isolated from said first well and extending downwardly from a ground surface to intersect said first working tunnel so as to communicate spatially with said first working tunnel and so as to permit access into said end segment of said first working tunnel for operation and maintenance of said primary pipeline;

wherein said end segment of said first working tunnel defines a plurality of working chambers and a main connecting chamber in spatial communication with said working chambers, each of said working chambers being partitioned to form a plurality of compartments that are isolated from each other, each of said compartments being defined by a compartment-defining wall that has a compartment entrance and that is provided with a compartment gate for opening and closing said compartment entrance, said primary pipeline including a main pipe and a plurality of branch pipes, each of which is connected to said main pipe, each of which extends into a respective one of said working chambers, and each of which has a plurality of sub-branch pipes, each of said sub-branch pipes of each of said branch pipes extending through a respective one of said compartments and into the ocean, and having a first section disposed in the respective one of said compartments and provided with a first control valve for blocking and unblocking ocean water flowing therethrough.

6. The ocean water drawing system as claimed in claim 5, wherein each of said sub-branch pipes of each of said branch pipes further has a second section extending from said first section, disposed outwardly of the respective one of said compartments, and provided with a second control valve for blocking and unblocking ocean water flowing therethrough.

7. The ocean water drawing system as claimed in claim 6, wherein said first pipeline unit further includes a secondary pipeline disposed in said first working tunnel and having one end extending into said first well and the other end extending through said end segment of said first working tunnel and into the ocean so as to permit ocean water to flow into said first well through said secondary pipeline.

8. The ocean water drawing system as claimed in claim 5, wherein said working chambers communicate spatially with said main connecting chamber through a plurality of branch connecting chambers, respectively, each of said branch connecting chambers being provided with a partitioning wall that isolates said main connecting chamber from the respective one of said working chambers, that has an entrance, and that is provided with a gate for opening and closing said entrance.

9. The ocean water drawing system as claimed in claim 7, wherein said secondary pipeline includes a main pipe and a plurality of branch pipes, each of which is connected to said main pipe of said secondary pipeline, each of which extends into a respective one of said working chambers, each of which joins a respective one of said branch pipes of said primary pipeline, and each of which has a plurality of sub-branch pipes, each of said sub-branch pipes of each of said branch pipes of said secondary pipeline joining said second section of a respective one of said sub-branch pipes of a respective one of said branch pipes of said primary pipeline, and being provided with a third control valve for blocking and unblocking ocean water flowing therethrough.

10. An ocean water drawing system comprising:

a first well adapted to be disposed adjacent to a seashore;

a first working tunnel disposed underground and extending between said first well and the seashore, said first working tunnel being isolated from said first well and the ocean, and having an end segment distal from said first well and proximate to the seashore;

a first pipeline unit including a primary pipeline disposed in said first working tunnel, and having one end extending sealingly into said first well and the other end extending through said end segment of said first working tunnel and into the ocean so as to permit ocean water to flow into said first well through said primary pipeline;

an access tunnel isolated from said first well and extending downwardly from a ground surface to intersect said first working tunnel so as to communicate spatially with said first working tunnel and so as to permit access into said end segment of said first working tunnel for operation and maintenance of said primary pipeline;

a second well adapted to be disposed adjacent to the seashore; a second working tunnel extending between said second well and the seashore, said second working tunnel being isolated from said second well and the ocean, and having an end segment distal from said second well and proximate to the seashore; and a second pipeline unit including a primary pipeline disposed in said second working tunnel and having one end extending into said second well and the other end extending through said end segment of said second working tunnel and into the ocean so as to permit ocean water to flow into said second well through said primary pipeline of said second pipeline unit.

11. The ocean water drawing system as claimed in claim 10, wherein said end segment of each of said first and second working tunnels defines a plurality of working chambers and a main connecting chamber in spatial communication with said working chambers, each of said working chambers being partitioned to form a plurality of compartments that are isolated from each other, each of said compartments being defined by a compartment-defining wall that has a compartment entrance and that is provided with a compartment gate for opening and closing said compartment entrance, each of said primary pipelines of said first and second pipeline units including a main pipe and a plurality of branch pipes, each of which is connected to said main pipe, each of which extends into a respective one of said working chambers of a respective one of said first and second working tunnels, and each of which has a plurality of sub-branch pipes, each of said sub-branch pipes of each of said branch pipes of each of said primary pipelines of said first and second pipeline units extending through a respective one of said compartments of a respective one of said working chambers of a respective one of said first and second working tunnels and into the ocean, and having a first section disposed in the respective one of said compartments of the respective one of said working chambers of the respective one of said first and second working tunnels and provided with a first control valve for blocking and unblocking ocean water flowing therethrough.

12. The ocean water drawing system as claimed in claim 11, wherein each of said sub-branch pipes of each of said branch pipes of each of said primary pipelines of said first and second pipeline units further has a second section extending from said first section, disposed outwardly of the respective one of said compartments of the respective one of said working chambers of the respective one of said first and second working tunnels, and provided with a second control valve for blocking and unblocking ocean water flowing therethrough.

13. The ocean water drawing system as claimed in claim 12, wherein said first pipeline unit further includes a secondary pipeline disposed in said first working tunnel and having one end extending into said first well and the other end extending through said end segment of said first working tunnel and into the ocean so as to permit ocean water to flow into said first well through said secondary pipeline of said first pipeline unit.

14. The ocean water drawing system as claimed in claim 13, wherein said second pipeline unit further includes a secondary pipeline disposed in said second working tunnel and having one end extending into said second well and the other end extending through said end segment of said second working tunnel and into the ocean so as to permit ocean water to flow into said second well through said secondary pipeline of said second pipeline unit.

15. The ocean water drawing system as claimed in claim 13, further comprising at least one interconnecting tunnel interconnecting said first and second working tunnels.

* * * * *